US012345097B2

(12) United States Patent
Rostvall

(10) Patent No.: US 12,345,097 B2
(45) Date of Patent: Jul. 1, 2025

(54) ROCK DRILL INSERT AND METHOD FOR MANUFACTURING A ROCK DRILL INSERT

(71) Applicant: EPIROC DRILLING TOOLS AKTIEBOLAG, Fagersta (SE)

(72) Inventor: Tomas Rostvall, Stockholm (SE)

(73) Assignee: EPIROC DRILLING TOOLS AKTIEBOLAG, Fagersta (SE)

( * ) Notice: Subject to any disclaimer, the term of this patent is extended or adjusted under 35 U.S.C. 154(b) by 0 days.

(21) Appl. No.: 18/259,607

(22) PCT Filed: Dec. 10, 2021

(86) PCT No.: PCT/SE2021/051231
§ 371 (c)(1),
(2) Date: Jun. 28, 2023

(87) PCT Pub. No.: WO2022/146214
PCT Pub. Date: Jul. 7, 2022

(65) Prior Publication Data

US 2024/0052708 A1 Feb. 15, 2024

(30) Foreign Application Priority Data

Dec. 30, 2020 (SE) ..... 2051573-0

(51) Int. Cl.
*E21B 10/567* (2006.01)
*C22C 29/06* (2006.01)

(52) U.S. Cl.
CPC ..... *E21B 10/567* (2013.01); *C22C 29/067* (2013.01)

(58) Field of Classification Search
CPC ..... E21B 10/56–58; C22C 29/067
See application file for complete search history.

(56) References Cited

U.S. PATENT DOCUMENTS

2001/0049019 A1 12/2001 Drake et al.
2014/0332286 A1 11/2014 Murdock et al.
(Continued)

FOREIGN PATENT DOCUMENTS

EP 2739418 A1 6/2014
EP 2847413 A1 3/2015
(Continued)

OTHER PUBLICATIONS

International Search Report and Written Opinion mailed Apr. 5, 2022 for International Application No. PCT/SE2021/051231, 10 pages.
(Continued)

*Primary Examiner* — Kristyn A Hall
(74) *Attorney, Agent, or Firm* — Sage Patent Group

(57) ABSTRACT

A rock drill insert a substrate having a tip portion and a base portion, wherein the tip portion includes a polycrystalline diamond (PCD) structure bonded to the substrate. The substrate is formed of a cemented carbide comprising at least 5 wt.-% of a metallic binder. At a distance of 50 μm from a surface of the base portion of the substrate, at least 20 vol.-% of the metallic binder is present in a hexagonal close packed (HCP) crystallographic form. Furthermore, a drill bit including a plurality of the above-described rock drill insert is disclosed, as well as a method for manufacturing the rock drill insert.

14 Claims, 5 Drawing Sheets

(56) References Cited

U.S. PATENT DOCUMENTS

| | | | | |
|---|---|---|---|---|
| 2019/0145181 | A1 | 5/2019 | Murdock et al. | |
| 2023/0184110 | A1* | 6/2023 | Lilja | C21D 9/22 51/309 |

FOREIGN PATENT DOCUMENTS

| | | | |
|---|---|---|---|
| JP | 2010-209398 | A | 9/2010 |
| WO | 2013017642 | A1 | 2/2013 |
| WO | 2013170083 | A1 | 11/2013 |
| WO | 2018113923 | A1 | 6/2018 |

OTHER PUBLICATIONS

Vasel, C.H. et al.; "Binder Deformation in WC-(Co, Ni) Cemented Carbide Composites,"; Metallugical Transactions A, vol. 16A, Dec. 1985; 9 pages.

Yang, J., et al.; "Grinding-induced metallurgical alterations in the binder phase of WC—Co cemented carbides"; Materials Characterization 134, 2017; 9 pages.

Nyrot, Elias; "Compressive stresses in cemented carbide"; Thesis, Uppsala Universitet; Jun. 2013; 46 pages.

Examination Report mailed Sep. 11, 2023 for Indian Patent Application No. 202347039375, 7 pages.

* cited by examiner

ROCK DRILL INSERT AND METHOD FOR MANUFACTURING A ROCK DRILL INSERT

CROSS-REFERENCE TO RELATED APPLICATIONS

This application is a 35 U.S.C. § 371 national stage application for International Application No. PCT/SE2021/051231, entitled "ROCK DRILL INSERT AND METHOD FOR MANUFACTURING A ROCK DRILL INSERT", filed on Dec. 10, 2021, which claims priority to Swedish Patent Application No. 2051573-0, filed on Dec. 30, 2020, the disclosures and contents of which are hereby incorporated by reference in their entireties.

TECHNICAL FIELD

The present disclosure relates in general to a rock drill insert. The present disclosure further relates in general to a drill bit comprising the rock drill insert. The present disclosure further relates in general to a method for manufacturing a rock drill insert.

BACKGROUND

Drilling, for example for mining and construction, may be made by drilling rigs, rods and drill bits. The drill bits are generally made of steel and often comprises very hard inserts in the front. The hard inserts are used to penetrate the earth and protect the drill bit against wear. A rock drill insert may typically be made of a composite material comprising particles of a hard phase of tungsten carbide (WC) cemented by a metallic binder. The cemented carbide may also comprise small additions of other hard carbide phases, such as TiC, NbC or TaC. The metallic binder may comprise cobalt (Co), nickel (Ni), iron (Fe) or an alloy thereof, such as a Co—Ni alloy or a Ni—Fe alloy. Moreover, small additions of elements such as V, Ta, Ti, Nb, Zr, and B may also be made to the metallic binder in some cases. The metallic binder may further comprise some W and/or C resulting from the manufacturing process as a result of being dissolved from the WC. This composite material is often called cemented carbide, tungsten carbide or hard metal. The cemented carbide is typically manufactured by powder metallurgical processes, including high temperature liquid sintering.

In order to increase the wear resistance of the conventional cemented carbide insert described above, the tip surface of the substrate (i.e. the surface which will first come into contact with the earth) may be coated with an even harder material. One example of such an insert comprises a cemented carbide substrate with a hard surface of a diamond composite material. The hard surface may typically be in the order of one to a few millimeters thick and comprise Polycrystalline Diamond (PCD). The hard surface is typically formed of a structure comprising one or more layers of PCD. The PCD layer(s) may be provided on the surface of the cemented carbide substrate with a HPHT (High Pressure High Temperature) process. Thereby, the PCD layer(s) are metallurgically bonded to the substrate. Each layer may comprise diamond and at least one metal, such as cobalt, as well as WC. In case of the structure comprising more than one layer, the different layers may often have different amounts of diamond and metal. An insert comprising a cemented carbide substrate and one or more PCD layers is often referred to as a PCD insert, but is sometimes also referred to as PDC, Polycrystalline Diamond Compact, or TSP, Thermally stable PCD. Previously known PCD inserts often comprises a substrate of cemented carbide comprising about 8-12 volume % Co-based binder, the remainder essentially consisting of WC.

One main limitation of previously known PCD inserts used in drilling is brittle fracture of the inserts. A brittle failure of one or more inserts in a drilling bit can substantially limit the service life of the drilling bit and stop the drilling process. Such a failure is often a dominating problem when using PCD inserts especially in percussive drilling, but also when drilling with rotary bits and shear cutters. Exchanging a drill bit with broken inserts is both time consuming and costly, especially in cases of drilling long holes, using automatic rigs or drilling in dangerous environments.

SUMMARY

It is an object of the present invention to reduce the risk of brittle failure of a rock drill insert and thereby increase the service life thereof.

This object is achieved by the subject-matter of the appended independent claim(s).

In accordance with the present disclosure, a rock drill insert comprising a substrate having a tip portion and a base portion is provided. A polycrystalline diamond structure is bonded to the tip portion of the substrate. The substrate is formed of a cemented carbide comprising at least 5 wt.-% of a metallic binder. At a distance of 50 μm from a surface of the base portion of the substrate, at least 20 vol.-% of the metallic binder is present in a hexagonal close packed, HCP, crystallographic form.

The rock drill insert according to the present disclosure has a substrate base portion with significantly improved toughness compared to conventional PCD inserts. In particular, the surface toughness of the base portion is improved thereby reducing the risk of brittle failure of the insert. This in turn results in longer service life of the rock drill insert, and hence also of a drill bit comprising the rock drill insert. This in turn significantly reduces the problem of undesired downtime for exchanging drill bits, and the costs associated with such a downtime and the new drill bits.

More specifically, the toughness of the base portion of the substrate is improved at least partly as a result of the metallic binder phase comprising a significant amount of HCP at a relatively deep distance from the outer surface of the base portion of the substrate. The HCP crystallographic structure is a result of a phase transformation in the metallic binder from the face centered cubic, FCC, crystallographic form present after the sintering of the cemented carbide and formation of the PCD structure on the cemented carbide substrate.

The metallic binder may comprise cobalt. Preferably, the metallic binder constitutes cobalt or constitutes a cobalt based alloy comprising nickel and/or iron. Such a metallic binder is suitable for use in a rock drill insert comprising a PCD structure, and may also enables the phase transformation to HCP.

At a distance of 100 μm from the surface of the base portion of the substrate, at least 10 vol.-% of the metallic binder may be present in the hexagonal close packed crystallographic form; preferably wherein at least 20 vol.-% is present in the hexagonal closed packed, HCP, crystallographic form. Thereby, the toughness of the substrate is further improved, thereby providing improvements in the toughness of the rock drill insert.

Moreover, at a distance of 50 μm from the surface of the base portion of the substrate, at least 10 vol.-% of the metallic binder may be present in a face centered cubic, FCC, crystallographic form. Thereby, the rock drill insert comprising said base portion of the substrate may have an appropriate impact toughness.

The cemented carbide may comprise at least 8 wt.-% of the metallic binder. Thereby, the toughness of the substrate and the rock drill insert is further improved. Preferably, the cemented carbide comprises at least 10 wt.-% of the metallic binder.

The substrate may have a fracture toughness K1c, measured according to 15028079 with 30 kg load, of at least 12 MPa$\sqrt{m}$ when measured 1 mm from said surface of the base portion of the substrate. Preferably, the substrate has a fracture toughness K1c of at least 14 MPa$\sqrt{m}$ when measured 1 mm from said surface of the base portion of the substrate.

Furthermore, the substrate may have a fracture toughness K1c, measured according to 15028079 with 30 kg load, when measured 0.5 mm from said base portion of the surface of the substrate which is at least 2 units MPa$\sqrt{m}$ higher compared to when measured 5 mm from said surface. Thereby, an appropriate balance between the properties in the vicinity of the outer surface of the base portion of the substrate and the properties in the bulk of the substrate base portion may be achieved.

The substrate may exhibit compressive stresses, measured by XRD, at said surface of the base portion of at least 900 MPa; preferably at least 1200 MPa. Thereby, the toughness of the base portion of the substrate, at the outer surface thereof, is further improved.

Moreover, the substrate may exhibit compressive stresses, measured by XRD, at a distance of 1 mm from said surface of the base portion of at least 300 MPa, preferably at least 500 MPa. Thereby, the toughness of the base portion of the substrate is further improved.

The polycrystalline diamond structure may comprise at least two layers comprising polycrystalline diamond. Thereby, the peripheral surface of the PCD structure may have a suitable hardness while, for example, the problem associated with mismatch between a thermal expansion and elastic modulus of the substrate and PCD structure is minimized. Thus, by the PCD structure comprising at least two layers, the risk of delamination or chipping is reduced.

The cemented carbide may comprise WC. Thereby, an appropriate hardness and wear resistance of the cemented carbide may be achieved.

The present disclosure further provides a drill bit. The drill bit comprises a body and a plurality of the above-described rock drill insert. The drill bit has a considerably longer service life due to a reduced risk for brittle failure of the inserts. The drill bit may be a percussive drill bit, a rotary bit or a shear cutter.

Moreover, the present disclosure provides a method for manufacturing a rock drill insert comprising a substrate having a tip portion, a base portion, and a polycrystalline diamond structure bonded to the tip portion of the substrate. The method comprises a step of preparing a substrate of a cemented carbide comprising at least 5 wt.-% of a metallic binder, e.g., a cobalt metallic binder. In some example the method comprises preparing a substrate of a cemented carbide comprising at least 8 Volume % of a metallic binder. The reason to use Volume % instead of Weight % is that if some amount cobalt is exchanged with another metal with lower specific density the weight % would change, but the volume % may stay the same. The function of the binder is more depending on the volume than the weight in a cemented carbide substrate. The method further comprises forming a polycrystalline diamond structure on a tip portion of the substrate such that said structure is bonded to the substrate. The method further comprises a treatment step of subjecting the substrate with the polycrystalline diamond structure bonded thereto to high energy tumbling or sonic vibration. The treatment step inducing a phase transformation in the metallic binder from a face centered cubic crystallographic form to a hexagonal close packed crystallographic form such that, at a distance of 50 μm from a surface of the base portion of the substrate, at least 20 vol.-% of the metallic binder will be present in the hexagonal close packed crystallographic form after said treatment step.

By means of the present method, a rock drill insert having a substrate base portion with significantly improved toughness compared to conventional PCD inserts may be obtained. Thereby, the risk of brittle failure of the insert is significantly reduced. This in turn results in longer service life of the rock drill insert, and hence also of a drill bit comprising the rock drill insert. This in turn significantly reduces the problem of undesired downtime for exchanging drill bits, and the costs associated with such a downtime and the new drill bits.

DETAILED DESCRIPTION

Figure 1:
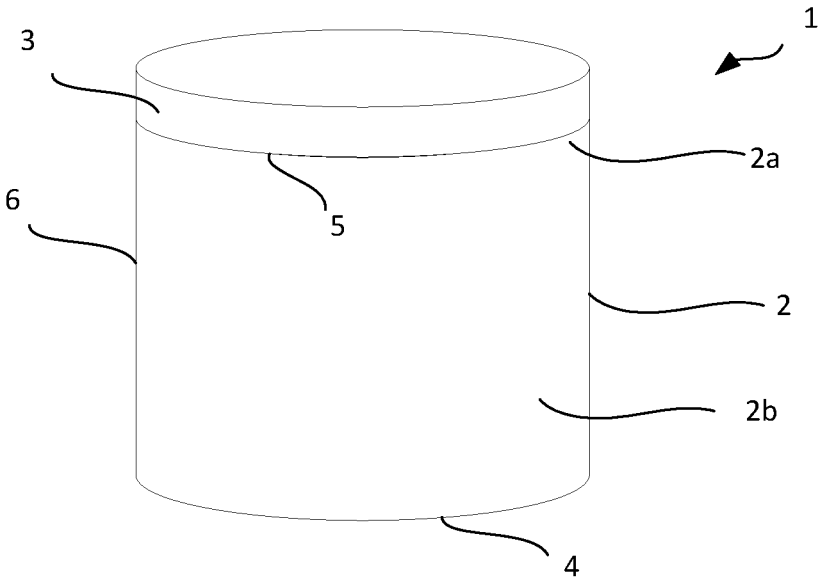
FIG. 1 illustrates a perspective view of a first exemplifying embodiment of a rock drill insert.

The invention will be described in more detail below with reference to exemplifying embodiments and the accompanying drawings. The disclosure is however not limited to the exemplifying embodiments discussed and/or shown in the drawings, but may be varied within the scope of the appended claims. Furthermore, the drawings shall not be considered drawn to scale as some features may be exaggerated in order to more clearly illustrate the invention or features thereof.

In accordance with the present disclosure, a rock drill insert is provided that comprises a substrate having a tip portion and a base portion, wherein a polycrystalline diamond structure is bonded to the tip portion of the substrate (such a rock drill insert hereinafter also denominated PCD insert). The substrate of the rock drill insert according to the present disclosure is formed of a cemented carbide comprising at least 5 wt.-% of a metallic binder, e.g., a cobalt metallic binder. In some examples, the substrate of the rock drill insert is formed of a cemented carbide comprising at least 8 Volume % of a metallic binder. Furthermore, at a distance of 50 μm from a surface of the base portion of the substrate, at least 20 vol.-% of the metallic binder is present in the hexagonal close packed (HCP) crystallographic form (herein also denominated HCP phase, or simply HCP).

It should here be noted that it is commonly known that a volume percentage of a specific constituent component of a material, such as a phase or the like, may be derived by considering a two-dimensional image of a cross sectional cut of the material and from this image determine an area percentage of the specific constituent component. Albeit not fully technically accurate, the area percentage of the specific component is then interpreted as corresponding to the volume percentage of the specific component. Thus, when used in the present disclosure, vol.-% shall be considered to correspond to the area-% unless explicitly disclosed otherwise.

As mentioned above, the substrate is formed of cemented carbide. The cemented carbide comprises at least 5 wt.-% of a metallic binder, e.g., a cobalt metallic binder. In case the cemented carbide comprises less than 5 wt.-% of the metallic binder, it is difficult to achieve a desired toughness and it may be more difficult to produce by means of liquid sintering without extra pressure. Preferably, the cemented carbide comprises at least 5.5 wt. % of the metallic binder. In some examples, the cemented carbide comprises at least 8 volume % of the metallic binder, and preferably at least 9 volume % of the metallic binder. The remainder of the cemented carbide, not being the metallic binder, essentially consists of one or more hard carbide phases (sometimes also referred to as hardmetal phases).

Although cemented carbides with binder contents of up to about 30 wt.-% are known in the art, the cemented carbide used in the rock drill insert according to the present disclosure may suitably comprise up to 13 wt.-% of the metallic binder. Higher amounts of metallic binder than 13 wt.-% may lead to an insufficient resistance to cyclic stress loading. Furthermore, if the metallic binder would be present in an amount of above 13 wt.-%, the thermal expansion coefficient of the cemented carbide may be too high and the elastic modulus too low for the cemented carbide to be suitable for use in a PCD insert. PCD layers generally have a lower thermal expansion coefficient and a higher elastic modulus than cemented carbide. Therefore, an increased amount of binder above 13 wt.-% may lead to a larger mismatch between the cemented carbide and the PCD layers. Preferably, the binder is present in an amount of up to 12 wt.-%. In some examples, the cemented carbide used in the rock drill insert according to the present disclosure may comprise up to 21 volume % of the metallic binder, and preferably an amount up to 19 volume % of the metallic binder.

The cemented carbide may comprise tungsten carbide (WC) as a hard carbide phase. WC may for example be present in an amount of at least 80 wt.-% of the cemented carbide, preferably at least 85 wt.-% of the cemented carbide. According to one alternative, WC is the only hard carbide phase of the cemented carbide. However, the cemented carbide may optionally also comprise additions of other hard carbide phases, such as titanium carbide (TiC), niobium carbide (NbC) or tantalum carbide (TaC). Such other hard carbide phases may be present in a total amount of up to 10 wt.-% of the cemented carbide, preferably in a total amount of up to 5 wt.-%.

The hard carbide phase(s) may have a particle size and particle size distribution in accordance with what is previously known in the art of cemented carbides for PCD inserts. By way of example, the WC phase may have a mean particle size within the range of 0.6-10 μm, preferably 1-5 μm. A mean particle size of WC lower than 0.6 μm may make to substrate to brittle, whereas a mean particle size above 10 μm may make the substrate too soft.

The metallic binder may comprise or consist of cobalt (Co), nickel (Ni), iron (Fe) or any alloy thereof, such as a Co-based alloy, a Co—Ni-based alloy, a Co—Fe-based alloy or a Ni—Fe-based alloy. The metallic binder alloy may further comprise Cr in an amount of up to 10 wt.-%, preferably up to 5 wt.-%. The metallic binder alloy may further comprise additions of alloying elements, such as V, Ta, Ti, Nb, Zr, Mo, Mn and B, up to a total content of 10 wt.-%, if desired. The metallic binder may further, as a result of the manufacturing process, comprise elements of the hard carbide phase(s) dissolved in the binder. In other words, the metallic binder may comprise some W and/or C resulting from the liquid phase sintering process during production of the insert. The amount of W and C in the metallic binder can be adjusted within the limits of formation of graphite or eta-phase in the binder. Normally, eta-phase decreases the toughness and graphite decreases the hardness and these phases should therefore be avoided, at least near the surface. Said adjustment is performed by controlling the respective amounts of the constituent components and the conditions during the liquid phase sintering step. Preferably, the metallic binder consists essentially of Co or a Co-based alloy, further comprising any W and/or C resulting from the liquid phase sintering step of the manufacturing process.

As mentioned above, at least 20 vol.-% of the metallic binder is, at a distance of 50 μm from a surface of the base portion of the substrate, present in the HCP crystallographic form. The remainder of the metallic phase, not being present in the HCP crystallographic form, is generally present in the face centered cubic (FCC) crystallographic form (herein also denominated FCC phase, or simply FCC).

In cemented carbide, cobalt (conventionally used as a binder for PCD insert substrates) may be present in two phase-structure variants, namely the FCC and HCP crystallographic forms mentioned above.

High temperatures, typically up to about 1400-1600° C., are used in the manufacturing of the cemented carbide substrate and also in the subsequent HPHT process used for providing the PCD structure on the surface of the substrate. FCC is the stable cobalt phase at temperatures above 418° C. and will thus inevitably be formed during the manufacturing process. If pure cobalt would be cooled to room temperature, the FCC phase would be transformed to HCP since HCP is the stable phase at room temperature. However, in cemented carbide, most of the cobalt retains the FCC phase also when cooled to room temperature (FCC is metastable at room temperature). This may be due to both inclusions in the cobalt, such as C and W, stresses and restraints from the WC grains.

HCP is generally considered in the art to be negative for the toughness in rock drill inserts. This is claimed to be due to the reduced ductility and crack-growth resistance of a HCP cobalt binder compared to FCC. Therefore, a transformation of FCC to HCP is generally sought to be avoided in the art of rock drill inserts, and cemented carbide with any substantial amount of HCP cobalt phase is not known to be used as substrate in base portions of PCD inserts.

In contrast thereto, the PCD insert according to the present disclosure comprises a substrate having a tip portion and a base portion, wherein the base portion of the cemented carbide substrate has a significant amount of HCP phase also at a relative deep distance from an outer surface of the substrate base portion. The HCP phase of the metallic binder is achieved by subjecting the cemented carbide substrate, with the polycrystalline diamond structure bonded thereto, to a treatment step inducing a phase transformation in the metallic binder from the FCC phase to HCP phase as will be described in further detail below. The phase transformation of the FCC phase to the HCP phase is believed to contribute to the increased toughness, especially near the surface of the base portion of the substrate. Most crack and shipping starts from the surface and therefore the toughness near the surface is especially important. One reason for the increased toughness is believed to be due to a martensitic transformation from FCC to HCP.

The toughness of a cemented carbide substrate increases with increasing amount of HCP, especially near the surface. Therefore, at a distance of 50 μm from the outer surface of the base portion of the substrate, preferably at least 35 vol.-% of the metallic binder may suitably be present in the hexagonal close packed (HCP) crystallographic form. In some cases, at least 50 vol.-% of the metallic binder may, at a distance of 50 μm from the outer surface of the base portion of the substrate, be present in the hexagonal close packed (HCP) crystallographic form. The remainder of the binder phase is generally present in the face centered cubic (FCC) crystallographic form. In some examples, the remainder of the binder phase is present in the FCC crystallographic form and/or in a partly amorphous structure. Thus, at a distance of 50 urn from the outer surface of the base portion of the substrate, at least 10 vol.-% of the metallic binder may be present in a face centered cubic (FCC) crystallographic form.

Considering a distance at of 100 μm from the surface of the base portion of the substrate, at least 10 vol.-% of the metallic binder may be present in the hexagonal close packed crystallographic form, preferably at least 20 vol.-% of the binder is present in the hexagonal closed packed crystallographic form at said distance from the base portion surface.

A previously mentioned, the cemented carbide comprises at least 5 wt.-% metallic binder, e.g., cobalt metallic binder, and/or 8 volume % of the metallic binder. Depending on the intended use of the rock drill insert and the corresponding desired properties, two preferred embodiments of metallic binder content in the cemented carbide may be considered. According to the first embodiment, the cemented carbide comprises from about 5.5 to about 7 wt.-% metallic binder (including the end values), e.g., cobalt metallic binder, and/or about 9 to about 12 volume % of metallic binder, which is consistent with conventional PCD inserts. According to the second embodiment, the cemented carbide comprises at least 8 wt.-% of metallic binder, e.g., cobalt metallic binder, and/or 13 volume % metallic binder, preferably from 10 to 12 wt.-% metallic binder, e.g., cobalt metallic binder, and/or 16 to 19 volume % (including the end values) of the metallic binder. The toughness of the cemented carbide increases with increasing amount of metallic binder, and the second embodiment therefore provides a higher toughness than the first embodiment. However, the first embodiment for example has the advantage of providing higher hardness of the cemented carbide and may therefore be desired in some instances. The hardness of a cemented carbide comprising about 5.5-7 wt.-% binder phase, e.g., cobalt binder phase, may for example be in the order of at least about 1400 HV (Vickers Hardness), whereas a cemented carbide comprising 10-12 wt.-% binder phase, e.g., cobalt binder phase, may have a hardness of about 1200-1350 HV, in case of a medium grain size of the hard carbide phase.

The substrate may have a fracture toughness, measured according to 15028079 with 30 kg load, of at least 12 MPa $\sqrt{m}$ when measured 1 mm from said surface of the substrate. Preferably, the substrate has a fracture toughness K1c, measured according to 15028079 with 30 kg load, of at least 14 MPa$\sqrt{m}$ when measured 1 mm from said surface of the base portion of the substrate. As mentioned above, the fracture toughness increases with increasing amount of metallic binder in the cemented carbide. Thus, in case the cemented carbide for example comprises at least 10 wt. % metallic binder, e.g., cobalt metallic binder, the fracture toughness of the substrate, measured according to 15028079 with 30 kg load, may typically be at least 20 when measured 1 mm from said surface of the bae portion of the substrate, preferably at least 22.

Furthermore, the substrate of the rock drill insert according to the present disclosure may suitably have a fracture toughness K1c, measured according to 15028079 with 30 kg load, when measured 0.5 mm from said surface of the base portion of the substrate which is at least 2 MPa$\sqrt{m}$ units higher compared to when measured 5 mm from said surface. It should be mentioned here that rock drill inserts with diameters less than 10 mm are sometimes used and the above given feature may in such cases naturally not be applicable. However, the substrate of the rock drill insert according to the present disclosure may suitably have a fracture toughness K1c, measured according to 15028079 with 30 kg load, when measured 0.5 mm from said surface of the base portion of the substrate which is at least 1.5 units higher compared to when measured 3 mm from said surface. Moreover, the fracture toughness, when measured according to 15028079 with 30 kg load, of the substrate may typically be at least 2 units higher, at a distance of 0.5 mm from the surface of the base portion of the substrate, compared to the fracture toughness of the substrate at said distance from the surface prior to the treatment step inducing the phase transformation from FCC to HCP.

Furthermore, the substrate of the rock drill insert according to the present disclosure may exhibit compressive stresses, measured by XRD, at the surface of the substrate of at least 900 MPa, preferably at least 1200 MPa. Moreover, the substrate may exhibit compressive stresses, measured by XRD, at a distance of 1 mm from the outer surface of the substrate of at least 300 MPa, preferably at least 500 MPa.

It should be noted that certain properties or features are described above with reference to a distance from a surface of the substrate. This shall be considered to mean that said property or feature is determined at such a specified distance, the distance being perpendicular to said surface of the substrate. In other words, the distance shall be considered to mean in a direction towards a central axis of substrate in case the surface is a longitudinal surface of the substrate, perpendicularly to the longitudinal surface. Moreover, albeit specific distances are given, this shall not be considered to mean that said property or feature is only present at the specific distance given. The purpose of specifying a distance is simply to specify where a comparison with for example a conventional PCD insert may be made. Moreover, the surface referenced when specifying a property or feature should be considered to mean a surface of the substrate which is not covered with the PCD structure unless explicitly specified otherwise. It should however be recognized that said property may in some cases also be present if measured at the same distance from the interface between the substrate and the PCD structure.

As previously mentioned, the rock drill insert comprises a polycrystalline diamond (PCD) structure bonded to a tip portion of the substrate. More specifically, the PCD structure is metallurgically bonded to the substrate. The PCD structure comprises diamond particles bonded together by diamond-to-diamond bonding and/or by a metallic binder, which may typically be Co or in some cases a Co-based alloy or other diamond catalysts like Ni and Fe. The PCD structure may be formed of a plurality of individual layers, each comprising the diamond particles and binder. The respective amounts of diamond and binder in the layers may differ from each other. The primary purpose thereof is to minimize the mismatch in for example thermal expansion between the substrate and the PCD structure at the interface between the substrate and the PCD structure, while still obtaining as high wear resistance as possible at the peripheral surface of the PCD structure. Thus, for said reason, a first PCD layer arranged closest to the substrate may typically have a higher content of binder compared to a second PCD layer arranged further from the interface to the substrate. The PCD structure used in the PCD insert according to the present disclosure may have any previously configuration of thereof previously known in the art for PCD inserts, and will therefore not be further discussed in the present disclosure.

The present disclosure further provides a method for manufacturing the above-described rock drill insert. The method generally comprises the steps of preparing the substrate of a cemented carbide comprising at least 5 wt. %, preferably at least 5.5 wt. %, of a metallic binder, e.g., cobalt metallic binder, forming a polycrystalline structure on a portion of the substrate and subjecting the substrate with the polycrystalline diamond structure bonded thereto to a treatment step inducing a phase transformation in the metallic binder from FCC to HCP. In some examples, the method comprises the steps of preparing the substrate of a cemented carbide comprising at least 8 Volume %, preferably, 9 Volume %, of a metallic binder.

As previously mentioned, the PCD insert according to the present disclosure comprises a cemented carbide substrate comprising a significant amount of HCP at a relative deep distance from the outer surface of the base portion of the substrate, and the HCP is a result of treatment step inducing a phase transformation from the, at room temperature, metastable FCC to HCP. Such a phase transformation is induced by increasing the driving force for said phase transformation. This may be achieved by increasing stresses in the substrate of the PCD insert, especially near the surface of the base portion of the substrate.

Generally, compressive stresses are known to increase toughness and strength in cemented carbides. There are several methods to obtain stresses which may increase the driving force for phase transformation, including grinding, blasting, shot peening, laser shot peening, tumbling, cascading, high energy tumbling, vibrations, and cryogenic treatment. However, not all of these methods are sufficient to increase the toughness in a base portion of the insert, i.e., in the substrate. By way of example, a conventional grinding process induces compressive stresses only at the very surface. Conventional PCD inserts are often ground to accurate dimensions. It is normal that some cobalt binder phase very close to the ground surface is transformed from FCC to HCP, this transformation coinciding with grinding-induced residual compressive stress. The depth of this transformed surface is very shallow, typically less than 0.02 mm.

In order to enable a phase transformation of FCC to HCP deeper than 0.02 mm into the cemented carbide, high energy tumbling or sonic vibrations can be used.

High energy tumbling is, in the present disclosure, considered to mean mechanical tumbling with enough energy to transform the material toughness at least 2 millimeters below the surface of a hard material like cemented carbide at least 2 MPa$\sqrt{m}$ units K1c. High energy tumbling generally comprises placing a large number of inserts, and optionally dummies, in a chamber and causing a movement of the inserts in the chamber by rotation of at least a part of the chamber, such that the inserts collide with each other as well as the walls of the chamber. One example of a high energy tumbling method that may be used is described in WO2016/186558. According to said method, a plurality of drill bit inserts are placed inside a chamber comprising a stationary side wall and bottom rotatable around a rotation axis. The bottom of the chamber comprises one or more protrusions which at least partly extend between the rotation axis and the side wall. The side wall of the chamber comprises pushing elements arranged around an inner periphery of the side wall. Upon rotation of the bottom, the inserts are moved around the rotational axis such that they form a torus shape, while simultaneously being pushed from the side wall by the pushing elements. Thereby, the inserts collide which each other as well as with the side wall with its pushing elements. If desired, insert dummies may also be added into the chamber such that the inserts will also collide with the dummies.

A sonic vibration treatment step generally comprises placing a plurality of inserts into a chamber and subjecting the chamber to vibrations causing the inserts to collide with each other as well as with the walls of the chamber. The vibrations may be achieved by a substantially horizontal vibration in combination with a rotation of the chamber, if desired. By appropriate selection of the amplitude and frequency of the vibrations, the energy may be controlled so as to achieve the desired compressive stress in the inserts. One example of such a vibration method that may be used is disclosed in WO 2013/135555 A1.

It should here be noted that the increase in toughness of the cemented carbide substrate is a result of the phase transformation from FCC to HCP, the compressive stresses and work deformation.

The rock drill insert as described above may be used in a drill bit. Such a drill bit generally comprises a plurality of rock drill inserts. The rock drill insert is especially suitable for use in percussive drill bits, rotary drill bits and in shear cutters. However, the rock drill insert may also be used in pick-applications, if desired. In such applications, an excavating tool comprising picks is typically rotatably mounted to a mining excavation machine or a road milling machine. These picks may comprise the insert as described herein.

FIG. 1 illustrates a perspective view of a first exemplifying embodiment of a rock drill insert 1. The rock drill insert comprises a substrate 2 having a tip portion 2*a*, a base portion 2*b*, and a polycrystalline diamond (PCD) structure 3 bonded to the tip portion 2*a* of the substrate. The substrate 2 has a substantially cylindrical configuration, and comprises a bottom surface 4 and an opposing top surface 5. The substrate also comprises a longitudinal surface 6, which is in the shape of a cylindrical surface.

The PCD structure 3 is bonded to the tip portion 2*a* of the substrate 2 through a metallurgical bonding, i.e., a metallurgical bonding to the top surface 5 of the substrate 2. The PCD structure 3 may be formed of one or more PCD layers which are metallurgically bonded to each other. The PCD structure may have an essentially cylindrical configuration and cover the whole top surface 5 of the substrate 2. When used in a drill bit, the PCD structure 3 is arranged at the tip portion 2*a* of the insert substrate 2. This means that the PCD-structure 3 faces the ground to be drilled and extends out of the drill bit body (see also FIG. 3). The bottom surface 4 and the longitudinal surface 6 of the substrate 2 both constitutes outer surfaces of a base portion of the insert. In other words, both the bottom surface 4 and the longitudinal surface 6 are free from any PCD layer or structure. When the insert is arranged in a drill bit, the bottom surface 4 and at least a portion of the longitudinal surface 6 are arranged in a corresponding recess of a body of the drill bit. The insert 1 shown in FIG. 1 is a so called flat tip insert due to the cylindrical configuration thereof.

Figure 2:
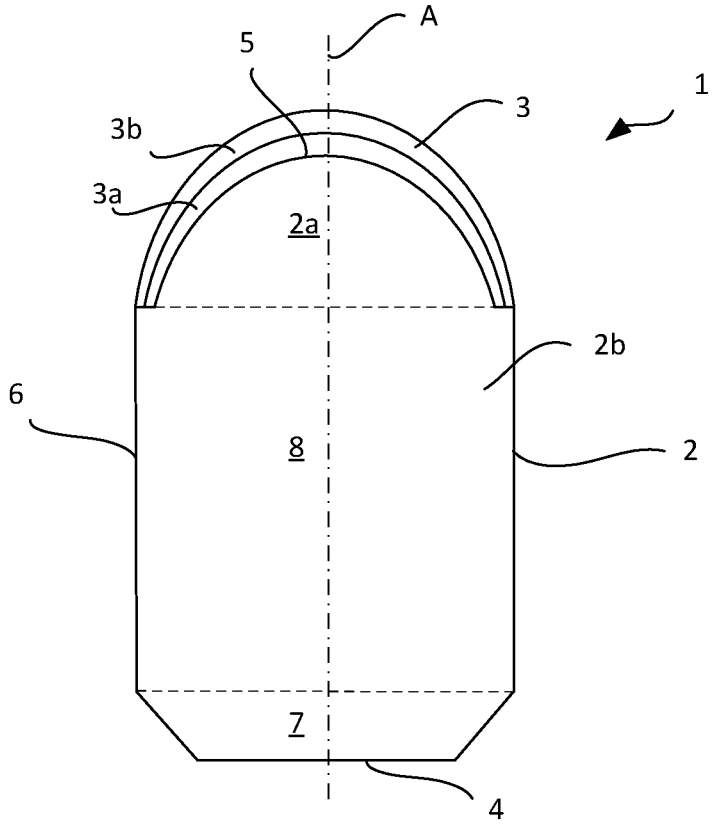
FIG. 2 illustrates a cross-sectional view of a second exemplifying embodiment of a rock drill insert.

FIG. 2 illustrates a cross-sectional view of a second exemplifying embodiment of a rock drill insert 1. The rock drill insert 1 according to the second exemplifying embodiment is similar to the first exemplifying embodiment shown in FIG. 1. However, the substrate 2 shown in FIG. 2 comprises a tip portion 2*a* and a base portion formed by an essentially cylindrical portion 8 in combination with a bottom portion 7. The essentially cylindrical portion 8 is arranged in between the bottom portion 7 and the tip portion 9 (as seen along a longitudinal center axis A of the substrate A and the insert 1). In the figure, the bottom portion 7, the essentially cylindrical portion 8, and the tip portion 2*a* are separated by dashed lines. It should however be noted that the portions 2*a*, 7, and 8 of the substrate together constitute a monolithic body which is formed in the step of producing the substrate.

The bottom portion 7 may for example have the configuration of a truncated cone, the base of such a truncated cone facing the cylindrical portion 8 of the substrate 2. This may for example facilitate the placing of the insert in a drill bit. The tip portion 9 of the substrate 2 may for example have a hemispherical, ogival or ballistic shape, but is not limited thereto. For example, the tip portion 9 may alternatively be in the form of a truncated cone.

The PCD structure is metallurgically bonded to a peripheral surface of tip portion 2*a*, which also constitutes the top surface 5 of the substrate 2. The PCD structure 3 may comprise one or more layers, such as a first PCD layer 3*a* and a second PCD layer 3*b* as illustrated in the figure.

Figure 3:
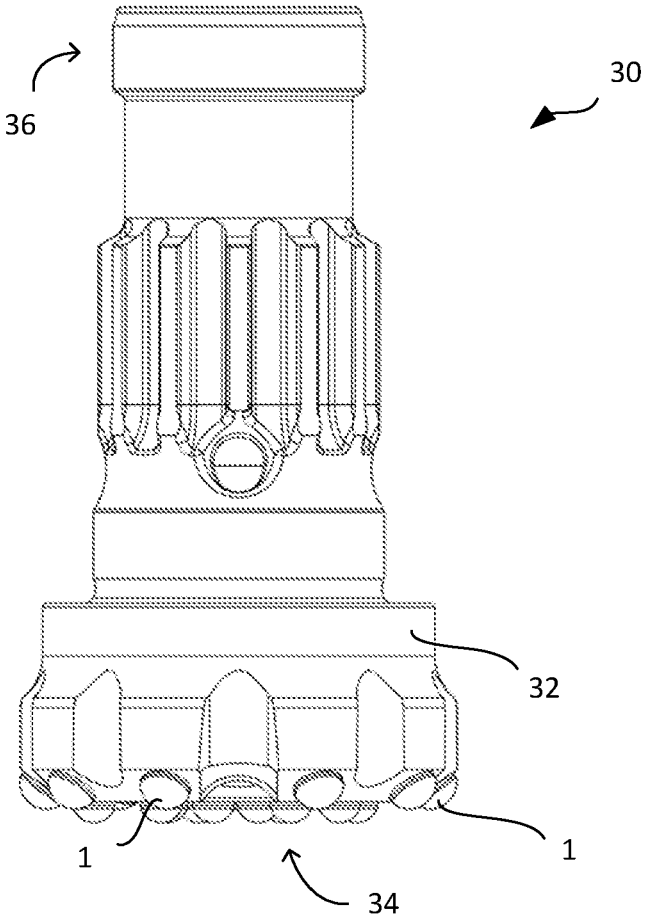
FIG. 3 illustrates a perspective view of an exemplifying drill bit which may comprise the rock drill insert according to the present disclosure.

FIG. 3 illustrates a perspective view of an exemplifying drill bit 30. More specifically, the drill bit 30 shown is a percussive drill bit. The drill bit 30 comprises a body 32 comprising a distal end 34, configured to face the ground to be drilled, and a proximal end 36, configured to be coupled to a drilling tool or hammer. The body 32 may typically be made of steel. A plurality of rock drill inserts 1 (as described above) are arranged in the body 32 at the distal end 34 thereof. The rock drill inserts 1 may for example be arranged in the body by being press-fit or shrink-fit into corresponding recesses of the body 32 while at least partly extending out of the body 32. More specifically, the inserts 1 are arranged such that at least the PCD structure thereof is arranged outside of the body 32.

Figure 4:
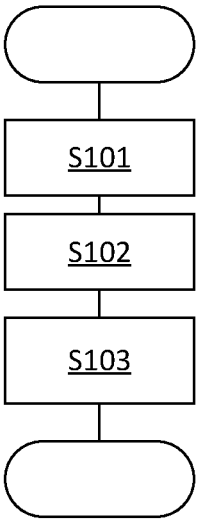
FIG. 4 represents a flowchart schematically illustrating a method for manufacturing a rock drill insert in accordance with one exemplifying embodiment of the present disclosure.

FIG. 4 represents a flowchart schematically illustrating a method for manufacturing a rock drill insert according to one exemplifying embodiment of the present disclosure. The rock drill insert is manufactured to comprise a substrate having a tip portion 2*a*, a base portion 2*b*, and a polycrystalline diamond structure bonded to the tip portion of the substrate. The method comprises a step of preparing S101 a substrate of a cemented carbide comprising at least 5 wt-% of a metallic binder, e.g., cobalt metallic binder, and/or 8 volume % of a metallic binder. The substrate may be prepared by conventional powder metallurgical processes for preparing cemented carbides. Such processes generally comprise mixing a powder of at least one hard carbide phase, such as WC, with a powder of binder phase, compressing the powder mixture to a green compact and subjecting the green compact to a liquid phase sintering step.

The method further comprises a step of forming S102 a polycrystalline diamond structure on a tip portion of the substrate such that said structure is bonded to a corresponding tip of the rock drill insert. The polycrystalline diamond structure may comprise one or more layers of polycrystalline diamond and may be formed on the surface by any previously known method therefore, and subsequent machining e.g., by diamond grinding.

The method further comprises a step of subjecting S103 the substrate, with the polycrystalline diamond structure bonded thereto, to a treatment step inducing a phase transformation in the metallic binder from a face centered cubic crystallographic form to a hexagonal close packed crystallographic form. As a result of said treatment step, at distance of 50 μm from a surface of the base portion of the substrate, at least 20 vol.-% of the metallic binder will be present in the hexagonal close packed crystallographic form after said treatment step. The treatment step performed in step S103 may for example comprise subjecting the substrate with the polycrystalline diamond structure bonded thereto to high-energy tumbling, a sonic vibration and/or a cryogenic treatment.

Experimental Results

In the following tests, PCD inserts of two different test grades were provided and compared with corresponding reference grades. All inserts were exposed to diamond grinding; inducing at least some phase transformation in the outer surface, i.e., at a maximum depth of 0.02 mm. The first test grade (herein denominated "Test 1") was achieved by subjecting a commercially available PCD insert (herein denominated "Reference 1") to a treatment step inducing a phase transformation in the binder of the substrate. The second test grade (herein denominated "Test 2") was produced by seeking to produce a substrate with a configuration as close as possible to a commercially available cemented carbide grade and then use it as substrate for a PCD insert, and subjecting said PCD insert to the treatment step inducing a phase transformation in the binder of the substrate. As a reference (herein denominated "Reference 2") a PCD insert, corresponding to Test 2, was produced but without performing the treatment step inducing a phase transformation in the binder of the substrate.

Table 1 specifies the general material data of the cemented carbide substrates of the examined inserts. In all of the tested grades, the hard carbide phase of the cemented carbide essentially consisted of WC, and the binder phase essentially consisted of Co. The PCD layers of Reference 1 and Test 1 were similar. Likewise, the PCD layers of Reference 2 and Test 2 were as similar as possible. The cobalt content specified in Table 1 was calculated from the density of the cemented carbide. The density was measured based on Archimedes principle; weight being measured in air and water. The coercivity, HC, was measured with a Foerster instrument calibrated with cemented carbide reference samples. Vickers Hardness (Hv) was measured according to Vickers ISO 3878 with 30 kg load. The WC grain size was calculated from electron backscatter diffraction (EBSD) surface images (obtained as described below) using the equivalent diameter method.

TABLE 1

| PCD insert-grade | Cobalt (wt.-%) | Density of cemented carbide (kg/dm3) | HC (kA/m) | Bulk Hardness (Hv 30 kg) | WC grain mean size (micron) |
|---|---|---|---|---|---|
| Reference 1 (comparative) | 6.0 | 15.0 | 9.4 | 1495 | 1.3 |
| Test 1 | 6.0 | 15.0 | 9.6 | 1494 | 1.3 |
| Reference 2 (comparative) | 11.0 | 14.5 | 5.3 | 1253 | 2.2 |
| Test 2 | 11.0 | 14.5 | 5.3 | 1256 | 2.0 |

In the treatment step used in the production of the Test 1 and Test 2 PCD inserts, a high energy tumbling according to the method as described in WO 2016/186558 A1 was used. The whole outer surface of the PCD inserts were exposed to the high energy tumbling, meaning that no part of the outer surface of the inserts were protected (such as by a rubber cover or the like). Some inserts did get chipping in this treatment, but this is believed to be a result of pre-existing defects. Thus, by accurate control of the production of the inserts prior to the after-treatment, said problem may be minimized. The PCD inserts damaged by chipping during the treatment were excluded from the examination and tests described below.

To analyze the phase transformation in the binder of the substrate, small samples were cut out from the PCD inserts. The cut was performed in a cylindrical base portion of the substrate, i.e., in the PCD insert (compare with exemplifying inserts shown FIGS. 1 and 2) essentially perpendicular to the outer surface of the PCD inserts. The samples were first ground then polished in several steps, including polishing to a mirror like finish using 1 μm diamonds in the final step. After diamond polishing, the samples were ion polished, removing roughly 50 micron from the diamond-polished surface. The ion polishing was made with Ar-canons with 2.6 mA and 7 kV during 15 hours. The ion-polished surfaces were orientated perpendicular to the outer surface, towards the core of the button. The samples were then analyzed both with EBSD and XRD. The EBSD analysis was made in a Zeiss Ultra 55 FEG-SEM equipped with an Oxford HKL Nordlys F EBSD-detector. The images were created with 20 kV, 60 micrometer aperture and 0.1 micrometer step size.

Figure 5:
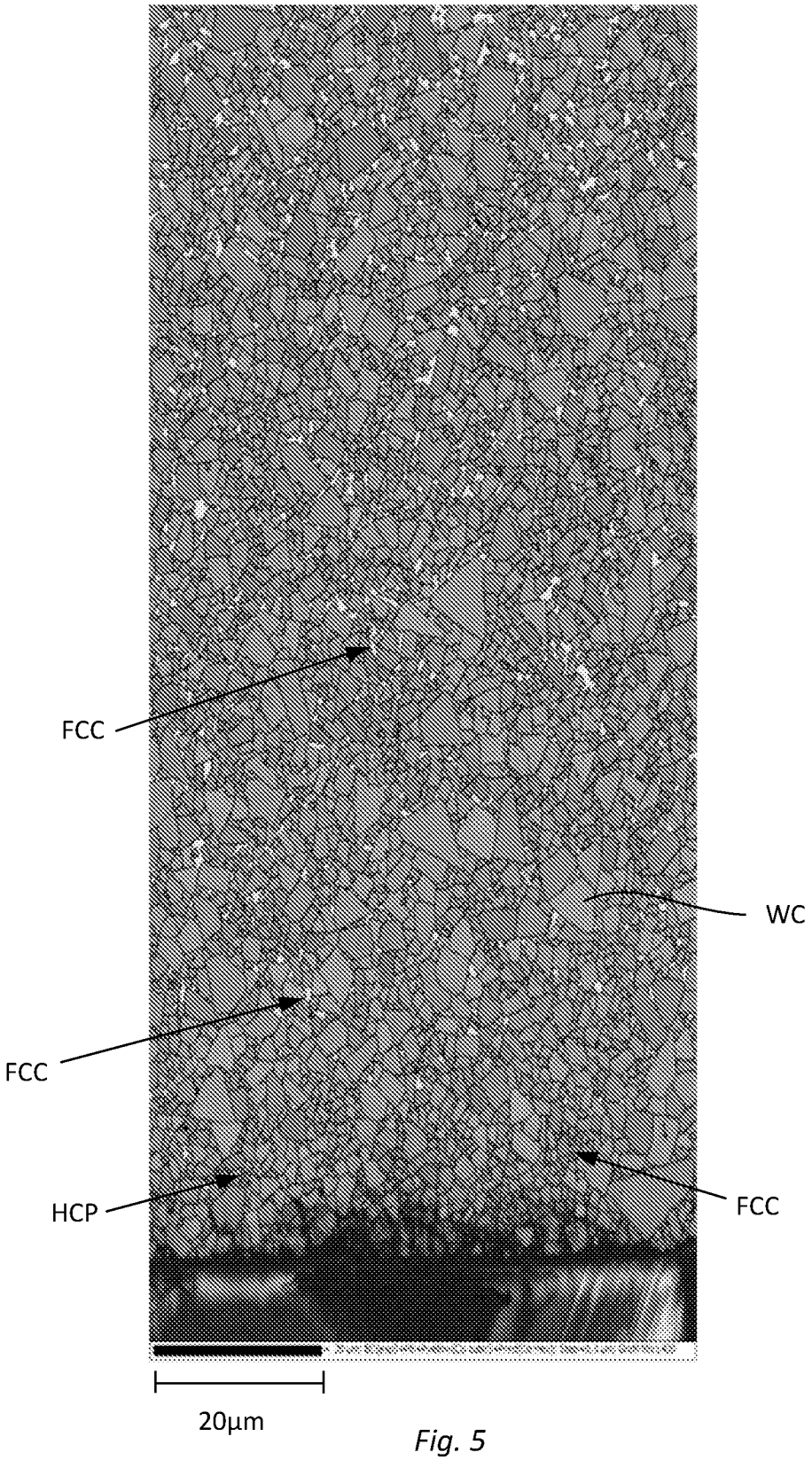
FIG. 5 shows an EBSD image of a cross sectional cut of the base portion of the substrate of the PCD insert denominated Reference 1.

FIG. 5 shows an EBSD image of Reference 1, obtained as described above. The outer surface of the substrate of the insert is at the bottom of the figure. It can be seen that the binder phase is predominantly present in the FCC phase (visible in the figure as white areas) and only a negligible amount of HCP phase (greyish area in the figure) is present very close to the surface. The arrows in the figure points to examples of where the respective phases were noted. The very small amount of HCP phase present at the surface of the insert is believed to be due to a conventional grinding step in the production of a PCD insert. The residual effect of the grinding can be seen at the bottom of figure.

Figure 6:
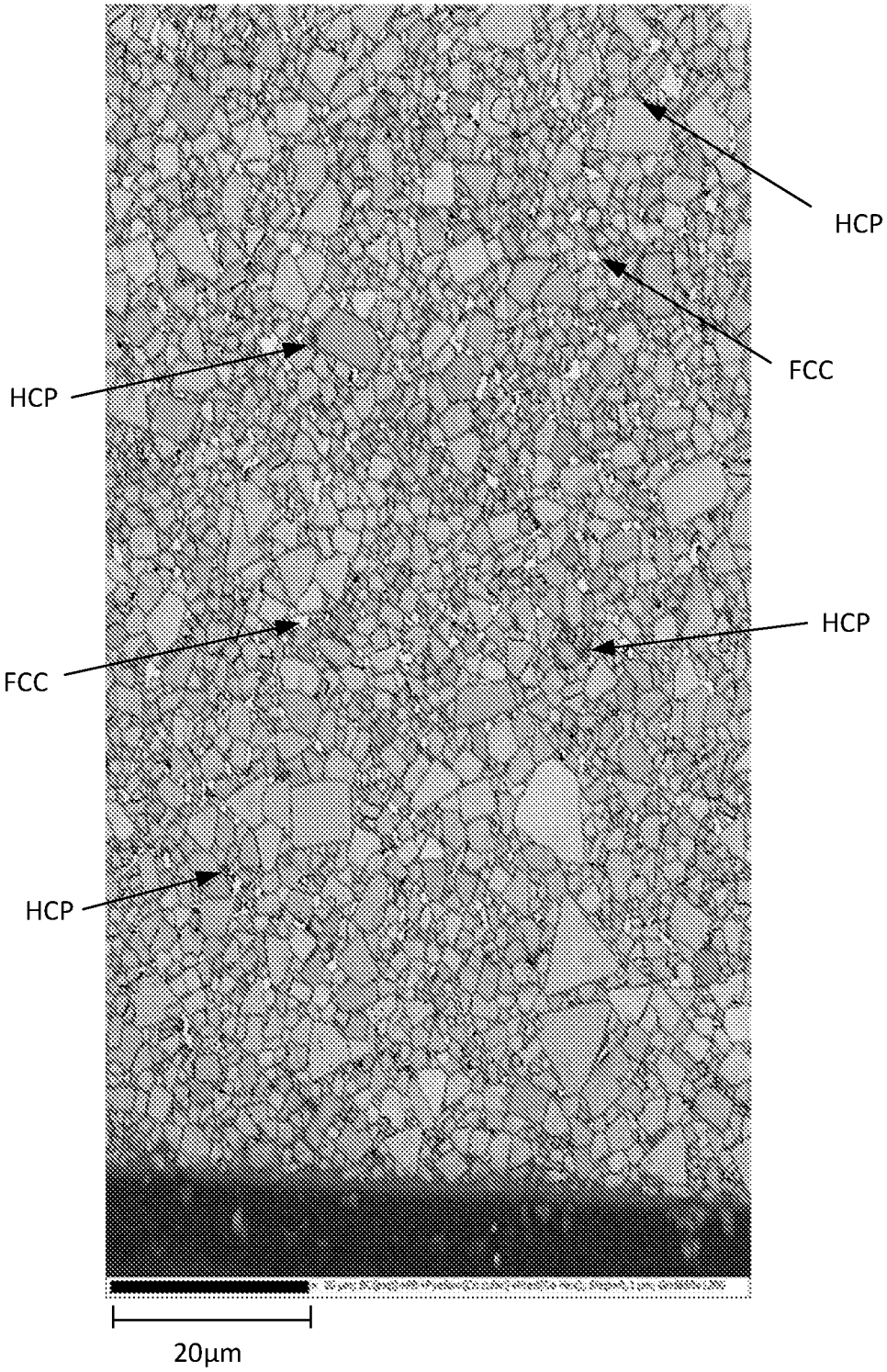
FIG. 6 shows an EBSD image of a cross sectional cut of the base portion of the substrate of the PCD insert denominated Test 1.

FIG. 6 shows an EBSD image of Test 1, obtained as described above. It can be seen that the binder phase of the substrate comprises a large amount of FCC phase but, compared to the image shown in FIG. 5, a drastically increased amount of HCP phase. In other words, the substrate of Test 1 shows a mixed cobalt structure with both FCC and HCP, especially near the outer surface. It can also be seen that the outer surface of Test 1, shows a smoother surface with less depletion of the binder, compared to Reference 1. Those properties also decrease the risk of crack initiation near the surface.

Figure 7:
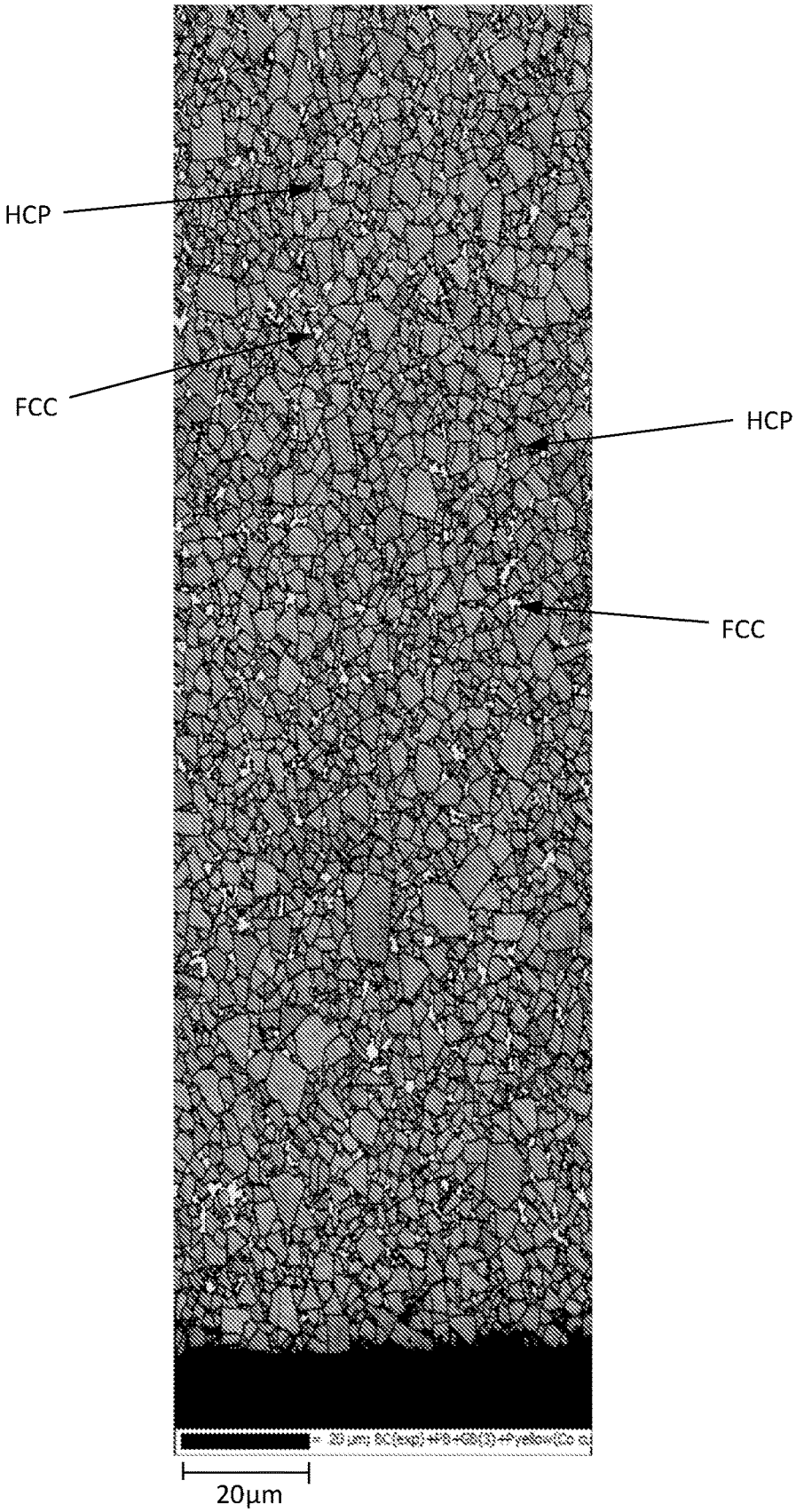
FIG. 7 shows an EBSD image of a cross sectional cut of the base portion of the substrate of the PCD insert denominated Test 2.

EBSD analysis was also performed for Test 2. Similarly to Test 1, it was found that Test 2 showed HCP well below the surface. Test 2 showed an even higher amount of phase transformation from FCC to HCP than Test 1. This is believed to be due to the higher amount of binder phase in Test 2 compared to Test 1, since Test 2 probably have less restrain in the cemented carbide due to lower amount of WC. Thereby, less energy is likely needed for the phase transformation from FCC to HCP. FIG. 7 shows an EBDS image of Test 2, obtained as described above.

In order to investigate the amount of HCP phase present at different distances from the surface of base portion of the substrate, the EBSD images were divided into a plurality of subsets maps each comprising a depth of 20 μm. The distance parallel to the surface of the substrate for each subset map was 65 μm. In other words, analysis for each subset map was performed on an area of 20×65 μm. In the table 2 given below, the average distance of the subset to the outer surface of the base portion of the substrate is given. For example, the subset given in the table as 50 μm thus ranged from 40 μm from the outer surface to 60 μm from the surface.

TABLE 2

| Subset | Vol % of HCP phase in metallic binder | |
|---|---|---|
| Average distance to surface [μm] | Test 1 | Reference 1 |
| 30 | 35.0 | 2.6 |
| 50 | 25.0 | 0.9 |
| 70 | 19.7 | 1.0 |
| 90 | 19.0 | 0.3 |

In order to semi-quantitatively confirm the amount of FCC and HCP phase present below the surface with an alternative method X-ray diffraction was used, the method is abbreviated as XRD. The same Reference 1 and Test 1 samples as for EBSD were used. Bragg-Brentano XRD phase analysis using Bruker D8 Discover XRD with CuKα radiation and 0.3 mm collimator on samples was performed. Analyzed area corresponds to 0.35 mm from the surface down to material, where the diameter of the analyzed area is 0.3 mm and depth 3 μm. Note that the analysis has a much lower resolution than the EBSD method above, but the analysis confirm that the treated Test 1 sample have much more HCP below the surface than Reference 1, see Table 3. For Reference 1 no HCP could be detected by means of XRD.

TABLE 3

| PCD insert-grade | FCC cobalt wt. % at 0.35 mm | HCP cobalt wt. % at 0.35 mm |
|---|---|---|
| Reference 1 | 4.8 | 0 |
| Test 1 | 4.9 | 1.7 |

In order to estimate the compressive stresses in the samples on and below the surface XRD was used. For the measurements on the surface, i.e., the surface exposed to diamond grinding, no preparation except cleaning was necessary. To be able to investigate compressive stresses below the surface the samples were cut 0.5 mm and 1 mm down into the cylindrical surface in parallel with the longitudinal center axis A, see FIG. 2. The cutting were made with EDM wire cutting creating smooth surfaces. The XRD residual stress analysis was performed with Bruker D8 Discover XRD by determining the peak shift using the sin 2ψ method including the peak broadening. The total stress in the samples were measured using the (301) reflection of WC with Cu Ka radiation. The diffraction angle 2Theta 146.6° and a beam diameter 1 mm were chosen where ψ varied from −51 to 51 and φ=0°. The results show that the treatment lower the compressive stress on the ground plus treated surfaces compared to only ground surfaces, see Table 4. This phenomenon is due to a relaxing of surface stresses due to the treatment. On the other hand, the residual compressive stresses at 0.5 mm and 1 mm below the surfaces were much higher. Note that negative stress values corresponds to compressive stress. The compressive stresses below the surface coincide with the phase transformation and the increased toughness.

TABLE 4

| PCD insert-grade | Stress MPa at surface | Stress MPa at 0.5 mm | Stress MPa at 1 mm |
|---|---|---|---|
| Reference 1 | −2100 | −230 | −220 |
| Test 1 | −1670 | −690 | −530 |

Furthermore, the toughness of the substrate of the inserts was analyzed in detail. The result thereof is presented below in Table 5. The toughness was analyzed according to Palmqvist, ISO 28079, with 30 kg load. The samples had first been cut and polished in order to show the properties at different distances from the outer surface of the cemented carbide substrate. The distance specified in Table 5 represents the distance from the outer surface of the substrate towards the core of the substrate. It can be seen from the results that the Test 1 insert-grade showed a much higher toughness, especially close to the surface compared to Reference 1. Similarly, Test 2 insert-grade showed higher toughness than Reference 2 close to the surface.

TABLE 5

| PCD insert-grade | K1c (MPa$\sqrt{m}$) at 0.5 mm | K1c (MPa$\sqrt{m}$) at 1 mm | K1c ( MPa$\sqrt{m}$) at 3 mm | K1c (MPa$\sqrt{m}$) at 5 mm | K1c (MPa$\sqrt{m}$) at 10 mm |
|---|---|---|---|---|---|
| Reference 1 | 11.6 | 12.0 | 12.4 | 11.2 | 11.2 |
| Test 1 | 14.7 | 14.4 | 12.8 | 12.6 | 11.8 |
| Reference 2 | 23.2 | 22.3 | 21.2 | 22.8 | 22.6 |
| Test 2 | 25.4 | 23.6 | 22.8 | 23.2 | 20.4 |

Moreover, the above described PCD inserts were tested during percussive drilling. The drilling bits used in these tests had the same configuration except for the respective inserts used. Each drilling bit had eight PCD inserts. Moreover, the drilling was performed in the same rock and under the same operational conditions for the drill rig. The drilling bits were designed to reduce the time needed for performing the tests. The tests were performed with three different peripheral heights of the inserts, L1, L2 and L3. The results are shown in Table 6.

TABLE 6

| PCD insert-grade in bits | Cobalt wt. % of substrate | At least 20 vol-% of binder present as HCP 50 μm below surface of substrate | Drilled meters*, until at least 2 seriously damaged** inserts |
|---|---|---|---|
| Reference 1 (L1) | 6 | NO | 47 |
| Reference 1 (L1) | 6 | NO | 92 |
| Test 1 (L3) | 6 | YES | >>100 |
| Test 2 (L1) | 11 | YES | >100 |
| Test 1 (L1) | 6 | YES | >>100 |
| Test 2 (L1) | 11 | YES | >>100 |
| Test 1 (L1) | 6 | YES | >>100 |
| Reference 1 (L1) | 6 | NO | 19 |
| Test 1 (L2) | 6 | YES | >>100 |
| Reference 1 (L2) | 6 | NO | 28 |
| Test 1 (L2) | 6 | YES | >>100 |

*The drilling had to be discontinued after 100 m for practical reasons. All bits with the drilled estimation >>100 m had inserts at 100 m without any defects. The one bit estimated as >100 had one insert with a partial damage at 100 m.

**17/20 broken inserts with brittle failure in the cemented carbide substrate, only 3/20 had chipping in PCD-layer.

From the results shown above in Table 6 it can, for example, be seen that the inserts according to Test 1 performed considerably better than Reference 1. Test 2 also showed considerably better results than Reference 1.

The invention claimed is:

1. A rock drill insert comprising a substrate having a tip portion and a base portion, wherein a polycrystalline diamond structure is bonded to the tip portion of the substrate and the polycrystalline diamond structure is devoid of bonding to the base portion of the substrate, wherein the substrate is formed of a cemented carbide comprising at least 5 wt.-% of a metallic binder, and wherein, at a distance of 50 μm from a surface of the base portion of the substrate, at least 20 vol.-% of the metallic binder is present in a hexagonal close packed crystallographic form.

2. The rock drill insert according to claim 1, wherein the metallic binder comprises one of cobalt or a cobalt based alloy comprising nickel and/or iron.

3. The rock drill insert according to claim 1, wherein, at a distance of 100 μm from the surface of the base portion of the substrate, at least 10 vol.-% of the metallic binder is present in the hexagonal close packed crystallographic form.

4. The rock drill insert according to claim 1, wherein, at a distance of 50 μm from the surface of the base portion of the substrate, at least 10 vol.-% of the metallic binder is present in a face centered cubic crystallographic form.

5. The rock drill insert according to claim 1, wherein the cemented carbide comprises at least 8 wt.-% of the metallic binder.

6. The rock drill insert according to claim 1, wherein the substrate has a fracture toughness K1c, measured according to ISO28079 with 30 kg load, of at least 12 MPa$\sqrt{m}$ when measured 1 mm from the surface of the substrate.

7. The rock drill insert according to claim 1, wherein the substrate has a fracture toughness K1c, measured according to ISO28079 with 30 kg load, when measured 0.5 mm from the surface of the substrate which is at least 2 MPa$\sqrt{m}$ units higher compared to when measured 5 mm from the surface.

8. The rock drill insert according to claim 1, wherein the substrate exhibits compressive stresses, measured by XRD, at the surface of at least 900 MPa.

9. The rock drill insert according to claim 1, wherein the substrate exhibits compressive stresses, measured by XRD, at a distance of 1 mm from the surface of at least 300 MPa.

10. The rock drill insert according to claim 1, wherein the polycrystalline diamond structure comprises at least two layers comprising polycrystalline diamond.

11. The rock drill insert according to claim 1, wherein the cemented carbide comprises tungsten carbide (WC).

12. A drill bit comprising a body and a plurality of rock drill inserts, each of the rock drill insert comprises a substrate having a tip portion and a base portion, wherein a polycrystalline diamond structure is bonded to the tip portion of the substrate and the polycrystalline diamond structure is devoid of bonding to the base portion of the substrate, wherein the substrate is formed of a cemented carbide comprising at least 5 wt.-% of a metallic binder, and wherein, at a distance of 50 μm from a surface of the base portion of the substrate, at least 20 vol.-% of the metallic binder is present in a hexagonal close packed crystallographic form.

13. The drill bit according to claim 12, wherein the drill bit is at least one of: a percussive drill bit, a rotary bit, or shear cutter.

14. A method for manufacturing a rock drill insert comprising a substrate having a tip portion, a base portion, and a polycrystalline diamond structure bonded to the tip portion of the substrate and the polycrystalline diamond structure is devoid of bonding to the base portion of the substrate, the method comprising:

preparing a substrate of a cemented carbide comprising at least 5 wt.-% of a metallic binder;

forming the polycrystalline diamond structure on the tip portion of the substrate such that the structure is bonded to the substrate; and subjecting the substrate with the polycrystalline diamond structure bonded thereto to high energy tumbling and/or sonic vibration, inducing a phase transformation in the metallic binder from a face centered cubic crystallographic form to a hexagonal close packed crystallographic form such that, at a distance of 50 μm from a surface of a base portion of the substrate, at least 20 vol.-% of the metallic binder is present in the hexagonal close packed crystallographic form.

* * * * *